US005345740A

United States Patent [19]

Huang

[11] Patent Number: 5,345,740

[45] Date of Patent: Sep. 13, 1994

[54] MODULAR ROOF STRUCTURE

[76] Inventor: Chien-Teh Huang, No. 105, Sec. 4, San-Ho Rd., Sanchung City, Taipei Hsien, Taiwan

[21] Appl. No.: 995,694

[22] Filed: Dec. 23, 1992

[51] Int. Cl.[5] ..... E04D 1/34

[52] U.S. Cl. ..... 52/551; 52/91.1; 52/519; 52/521

[58] Field of Search ..... 52/90.1, 90.2, 91.1, 52/518, 536, 519, 520, 521, 538, 539, 542, 549–551, 543, 550

[56] References Cited

U.S. PATENT DOCUMENTS

| | | | |
|---|---|---|---|
| 530,119 | 12/1894 | Niederlaender | 52/536 |
| 1,539,632 | 5/1925 | Belding | 52/520 |
| 2,699,128 | 1/1955 | Johnson | 52/90.1 |
| 3,417,531 | 12/1968 | Jones | 52/551 |
| 3,626,651 | 12/1971 | Kough et al. | 52/536 |
| 3,783,570 | 1/1974 | Storch | 52/536 X |
| 3,797,179 | 3/1974 | Jackson | 52/90.1 |
| 3,899,855 | 8/1975 | Gadsby | 52/90.1 |
| 4,015,391 | 4/1977 | Epstein | 52/520 |
| 4,269,012 | 5/1981 | Mattingly | 52/520 X |
| 4,955,170 | 9/1990 | Dannemann | 52/542 X |
| 4,958,471 | 9/1990 | Waddington | 52/551 X |
| 5,197,252 | 3/1993 | Tiscareno | 52/551 X |

FOREIGN PATENT DOCUMENTS

| | | | |
|---|---|---|---|
| 1509137 | 4/1969 | Fed. Rep. of Germany | 52/551 |

*Primary Examiner*—Carl D. Friedman
*Assistant Examiner*—Beth A. Aubray
*Attorney, Agent, or Firm*—Knobbe, Martens, Olson & Bear

[57] ABSTRACT

The modular roof structure includes a grid system with a plurality of parallel beams and a plurality of roof tiles provided on the parallel beams in an overlapping manner. The parallel beam has an engaging protrusion that projects upward. The roof tile has a front end that is provided with a hook portion to receive the engaging protrusion of the parallel beam, and a rear end which is provided with a projection to abut with the hook portion of an adjacent roof tile and a covering member which shields the hook portion from rain and sunshine.

6 Claims, 5 Drawing Sheets

MODULAR ROOF STRUCTURE

BACKGROUND OF THE INVENTION

1. Field of the Invention

The invention relates generally to the field of building construction and more particularly to a modular roof structure for a building.

2. Description of the Related Art

Modular roof structures are known in the art. FIG. 1 is an illustration of a conventional modular roof structure that includes a grid system which has a plurality of horizontal beams (11) provided on main beams (10) in a parallel manner, and a plurality of roof tiles (12) disposed on the horizontal beams (11) in an overlapping manner.

As shown in FIGS. 2 and 3, each of the roof tiles (12) has a curved front end (122) which is partially capped on the horizontal beam (11). An adjacent roof tile (12') has a hooked rear end (121) which overlaps the curved front end of the roof tile (12), and a securing nail (13) is hammered through the hooked and curved ends (121, 122) in order to fasten the roof tiles (12, 12') on the horizontal beam (11).

The following are the main drawbacks of the above described conventional modular roof structure:

(1) The roof tile in the conventional modular roof structure is made of steel, and is therefore heavy. It is tiresome to carry a plurality of roof tiles when fixing the roof tiles on the grid system.

(2) In order to facilitate the flow of rain water, the conventional roof structure is generally inclined. While fixing the roof tiles on the horizontal beam (11), the worker must climb up the beams (11), as shown in FIG. 2, in order to hammer the nails so as to fix the roof tiles on the beams (11). This involves danger and thus, the worker can not fully concentrate on the fixing operation, thereby downgrading the quality of the roof structure.

(3) The nails in the beams are susceptible to rusting due to rain water. This shortens the useful life of the nails, thus causing the untimely disengagement of roof tiles over a short period of time.

(4) As illustrated in FIG. 3, a single nail is used to secure the two adjacent roof tiles on the beam (11). The lower roof tile may turn upward relative to the upper roof tile when a strong wind blows from a lower side of the lower roof tile. This can cause the two adjacent roof tiles to collide with one another, thereby resulting in damage to the conventional modular roof structure.

SUMMARY OF THE INVENTION

Therefore, the objective of the present invention is to provide a modular roof structure which can overcome the above mentioned drawbacks.

More specifically, the main objective of the present invention is to provide a modular roof structure which can be assembled on the ground. The assembled modular roof structure is then raised by a known art so as to provide the same on the top of the building. Thus, the danger of nailing each of the roof tiles with the worker standing on the beams is eliminated, which consequently results in a shorter working time.

Still another objective of the present invention is to provide a modular roof structure which has means to prevent two adjacent roof tiles from colliding with one another due to the presence of strong winds. Thus, the useful life of the modular roof structure according to the present invention is prolonged when compared to the conventional modular roof structure.

Accordingly, the preferred embodiment of a modular roof structure of the present invention comprises: a grid system of structural beams including a plurality of parallel beams, each of which is provided with an engaging protrusion that projects upward from a top side of the parallel beam, the engaging protrusion being aligned with a corresponding engaging protrusion of an adjacent parallel beam; each of the parallel beams having a plurality of roof tiles provided thereon, each of the roof tiles overlapping with an adjacent roof tile on an adjacent one of the parallel beams, each of the roof tiles being made of aluminum alloy and having a front end and a rear end opposite to the front end, the front end being provided with a hook portion including an oblique section extending from the front end, a horizontal section extending from the oblique section and a vertical section extending from the horizontal section, the vertical section cooperating with the oblique and the horizontal sections to form a receiving space of predetermined depth for receiving the engaging protrusion therein, the vertical section having a lower end that abuts with the parallel beam, the rear end of the roof tile having a projection that extends downward to abut with the hook portion of the adjacent roof tile on the adjacent one of the parallel beams, the rear end further having a covering member that extends therefrom and that covers the hook portion of the adjacent roof tile; and means for fastening the hook portion and the projection of the adjacent roof tile on the parallel beam.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENTS

Figure 5:
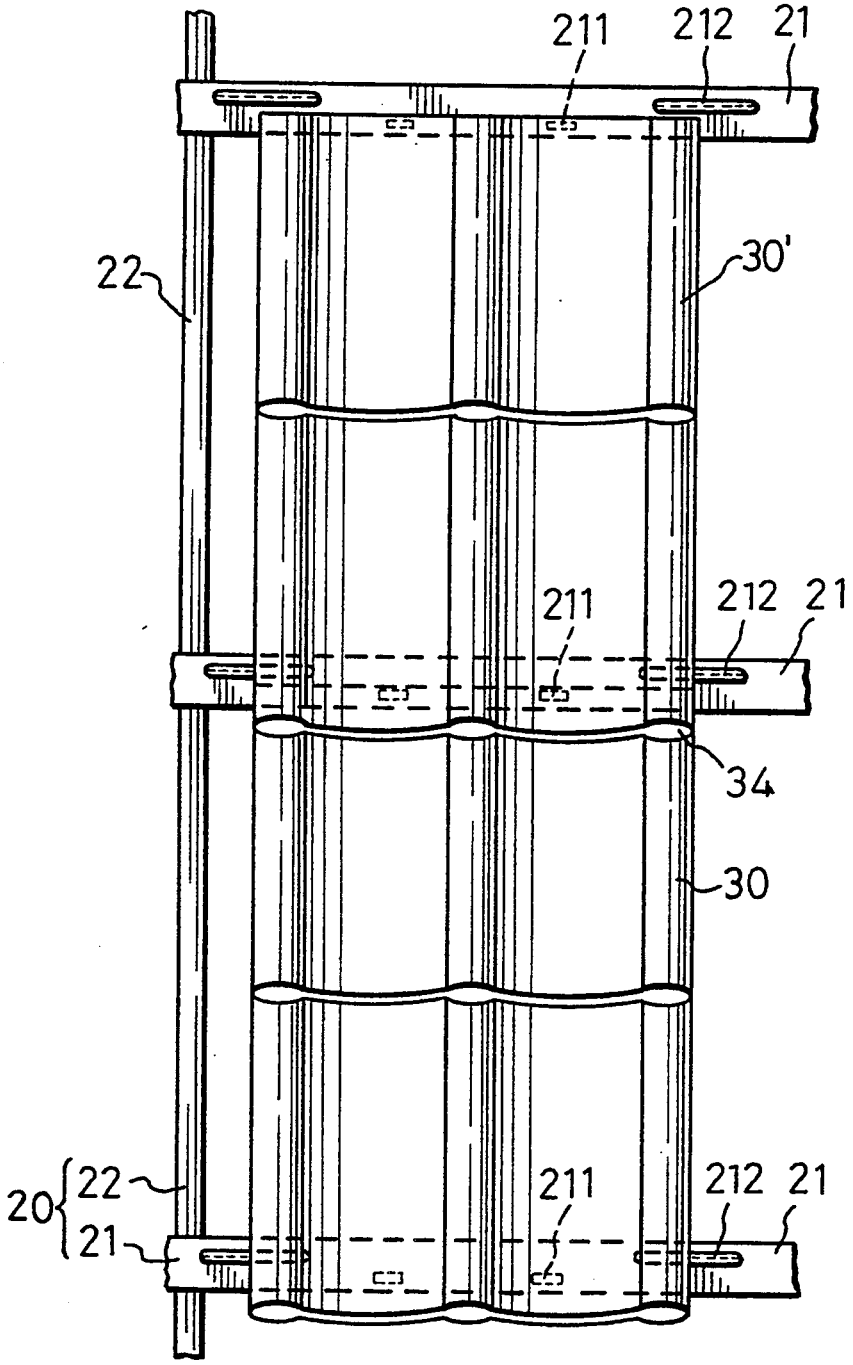
FIG. 5 is a top view of the modular roof structure of the present invention.
Figure 8:
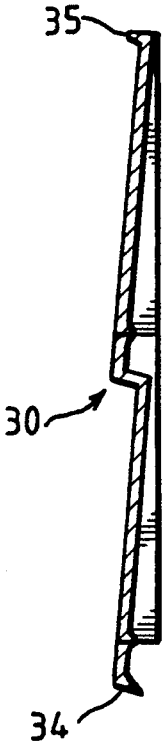
FIG. 8 is a side view of the modular roof structure of FIG. 7.
Figure 7:
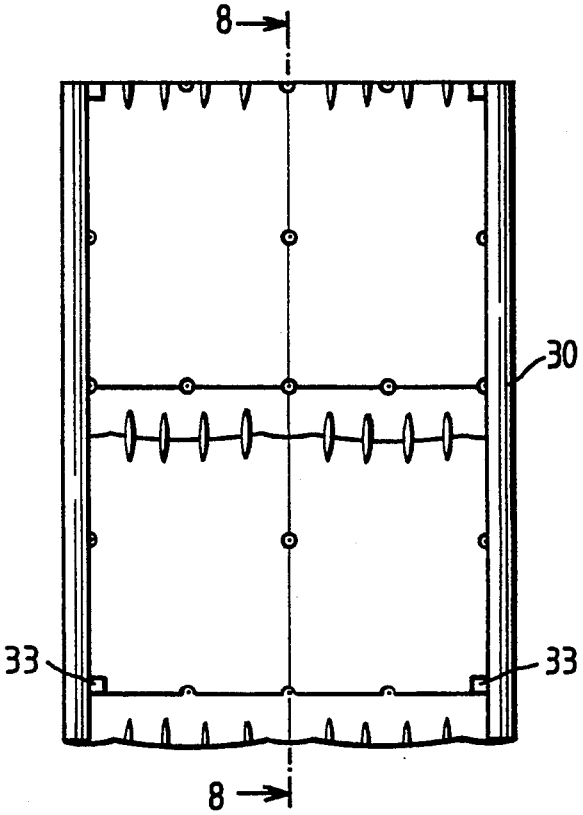
FIG. 7 is a top view of the modular roof structure of the present invention.
Figure 9:
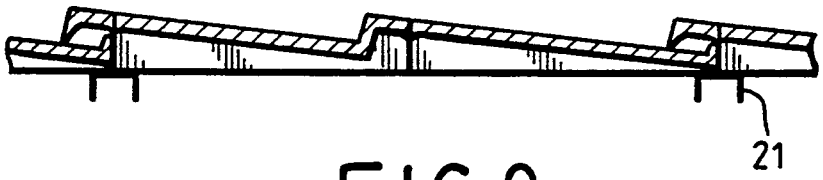
FIG. 9 is a side view of the modular roof structure shown in FIG. 6.
Figure 10:
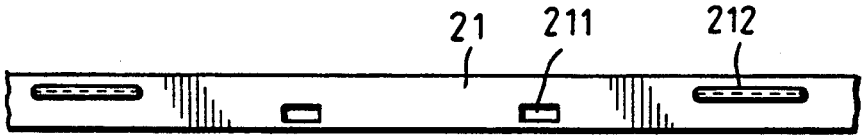
FIG. 10 shows a part of the modular roof structure of FIG. 5.

Referring to FIG. 5, a preferred embodiment of a modular roof structure according to the present invention is shown to comprise a grid system (20) and a plurality of roof tiles (30, 30') provided on a top side of the grid system (20) so as to cover the grid system (20).

As illustrated, the grid system (20) includes a plurality of parallel beams (21) provided on main support beams (22). Each of the parallel beams (21) has an elongated slot (212) extending therethrough and an engaging protrusion (211) projecting upward from a top side of the same. The engaging protrusion (211) and the elongated slot (212) of the parallel beam (21) are respectively aligned with the corresponding engaging protrusion (211) and the elongated slot (212) of an adjacent parallel beam (21).

Each of the parallel beams (21) has a plurality of roof tiles (30, 30') provided thereon. Each of the roof tile (30) overlaps with the roof tile (30') of an adjacent parallel beams (21), as shown in FIG. 5. The roof tile (30, 30') in the present embodiment is made of an aluminum alloy and has a front end (31) and a rear end opposite to the front end. The front end (31) of the roof tile is provided with a hook portion which includes a fourth or oblique section (311) that extends inclinedly and upwardly therefrom, a third or horizontal section (312) that extends from the oblique section (311), and a second or vertical section (313) that extends downwardly from the horizontal section (311). The second or vertical section (313) cooperates with the oblique and horizontal, or the fourth and third sections (311, 312) so as to form a receiving space (315) of predetermined depth which receives the engaging protrusion (211) therein. The second or vertical section (313) has a lower end that abuts with the parallel beam (21).

Figure 1:
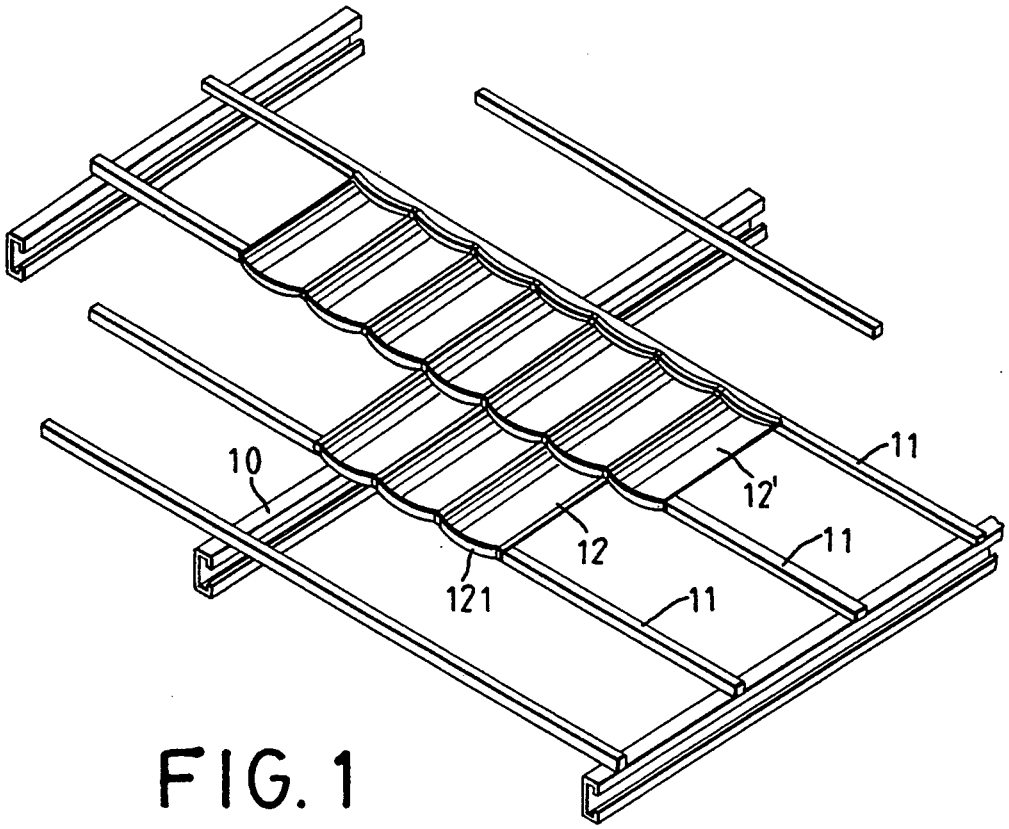
FIG. 1 PRIOR ART
FIG. 1 is an illustration of a conventional modular roof structure.
Figure 2:
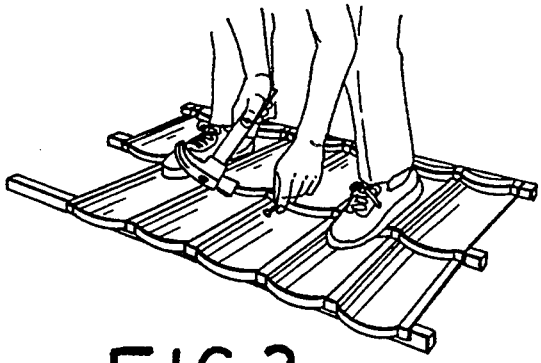
FIG. 2 PRIOR ART
FIG. 2 is a perspective view of the conventional modular roof structure to illustrate how the roof tiles are nailed together in order to form the conventional modular roof structure.
Figure 3:
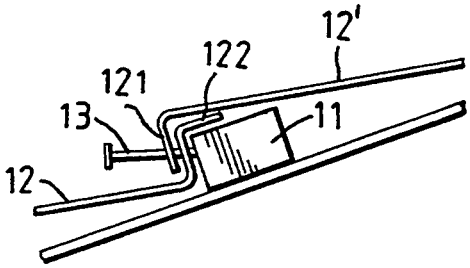
FIG. 3 PRIOR ART
FIG. 3 is a side view of the conventional modular roof structure which illustrates the nailing procedure for fixing the roof tiles together in order to form the conventional modular roof structure.
Figure 4:
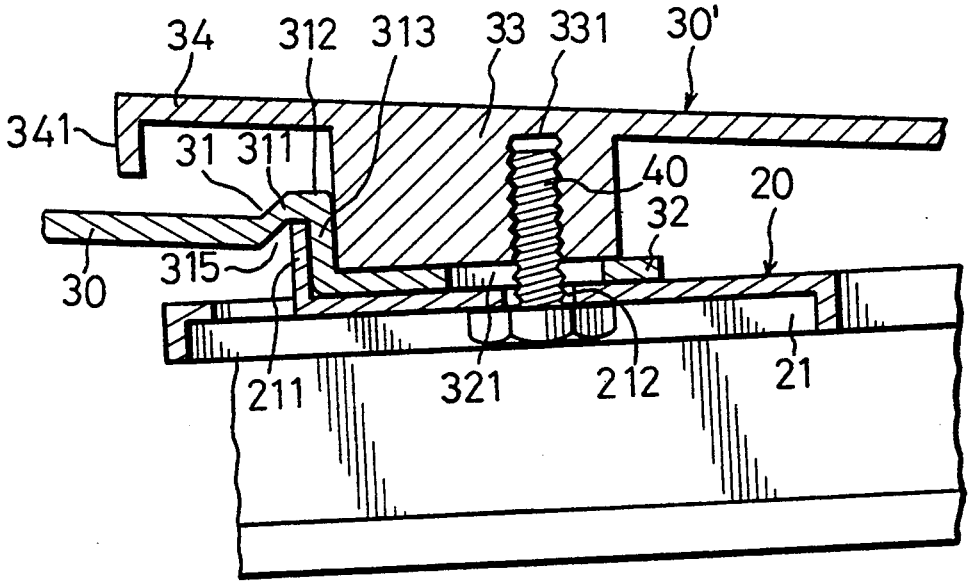
FIG. 4 is a partially cross sectional view of a preferred embodiment of a modular roof structure of the present invention.

The rear end of the roof tile (30') has a projection (33) that extends downwardly in order to abut with the vertical section (313) of the front end (31) of an adjacent roof tile (30) on the adjacent one of the parallel beams (21). The projection (33) is provided with a threaded bore (331). The rear end of the roof tile (30) further includes a covering member (34) that extends therefrom and that covers the front end (31) of an adjacent roof tile, as shown in FIG. 4.

A fastening means is employed in the present embodiment in order to secure a pair of adjacent roof tiles (30, 30') on the parallel beam (21). The fastening means includes a first section or elongated plate (32) that extends from a lowermost end of the second or vertical section (313) of the front end (31) of the roof tile (30) and a locking bolt (40). The first sections or elongated plate (32) has an opening (321). Therefore, the locking bolt (40) can be inserted through the elongated slot (212) of the parallel beam (21) and the opening (321) of the elongated plate (32) and is threaded in the threaded bore (331) of the projection (33) in order to lock the three elements together. Therefore, the front end of the roof tile (30) can not turn upward relative to the adjacent roof tile (30'), and thus, the two adjacent roof tiles (30, 30') are prevented from colliding with one another when a relatively strong wind blows.

Figure 6:
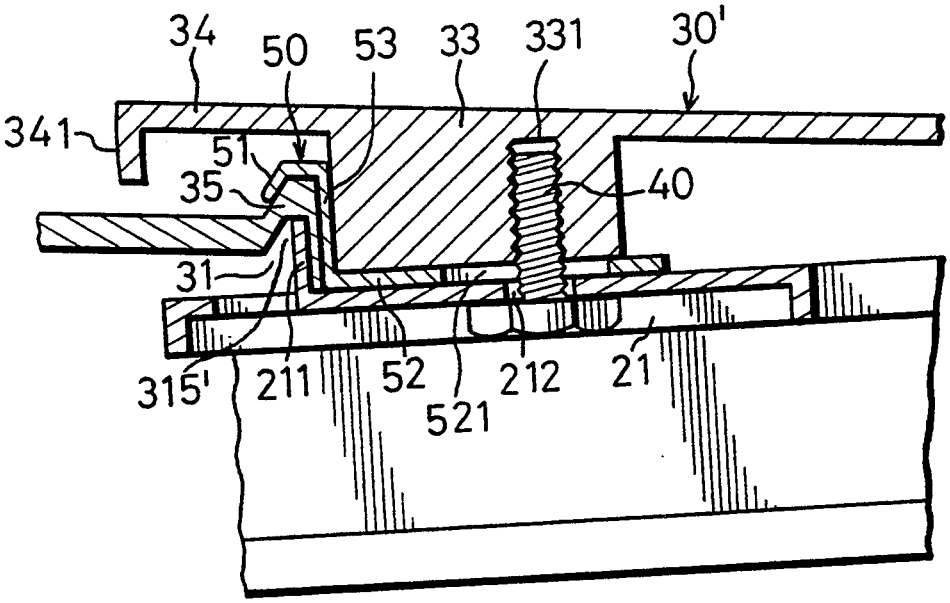
FIG. 6 is a partially cross sectional view of a second preferred embodiment of the modular roof structure of the present invention.
Figure 11:
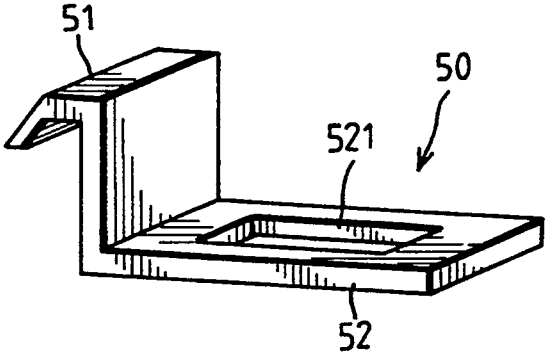
FIG. 11 shows a steel plate used in the modular roof structure of the present invention.

It has been discovered that the roof tiles (30, 30'), which are made of aluminum alloy, have a limited rigidity such that, in the event of very strong winds, the adjacent roof tiles (30, 30') may collide with one another, thereby damaging the modular roof structure of the present invention. In order to prevent this from happening, a steel member (50), which has a rigidity that is better than that of aluminum alloy, is employed in another embodiment. As shown in FIG. 6, the fastening means includes the steel member (50) and a locking bolt (40). The steel member (50), as illustrated in FIG. 11, includes an inverted L-shaped member (53), a curved stud (51) which extends inclinedly and downwardly from the inverted L-shaped member (53) and which cooperates with the same so as to depress the hook portion (35) of an adjacent roof tile (30), and an elongated projection (52) that extends from a lowermost portion of the inverted L-shaped member (53). The elongated projection (52) has an access hole (521). The locking bolt (40) is inserted through the elongated slot (212) of the parallel beams (21) and the access hole (521) of the elongated projection (52), and is threadedly engaged in the threaded bore (331) of the projection (33) in order to lock the three elements together. The roof tile (30) does not turn upward with respect to the adjacent roof tile (30') due to the compression force of the steel member (50) on the hook portion (35). The steel member (50) prevents the collision of two adjacent roof tiles (30, 30') when a very strong wind blows.

The covering member (34) of the rear end of the roof tile (30, 30') extends outwardly of the hook portion (35) and has a lid (341) that extends downwardly to shield the hook portion (35) from rain water and sun light. Therefore, the locking bolt (40) that connects the roof tiles (30, 30') on the parallel beam (21) does not rust easily, thereby prolonging the useful life of the locking bolts (40).

The elongated slot (212) formed through the parallel beam (21) permits the adjustment of the adjacent roof tiles on the parallel beam (21) during the fixing procedure.

Referring to FIG. 5, the modular roof structure of the present invention can be assembled on the ground in small units, each of which includes a predetermined number of roof tiles. As shown in FIG. 5, each of the modular roof units includes four roof tiles and is first assembled on the ground. A plurality of modular roof units form a modular roof structure of the present invention. The assembled modular roof units are lifted to the top of the building and are fixed on the main structural beams in a manner similar to that in the conventional modular roof structure. This can shorten the working time. A worker has to stay for a shorter period of time on the top of the building in order to install the modular roof structure of the present invention. Thus the danger of falling from the top of the building is correspondingly reduced.

While preferred embodiments have been illustrated and described, it will be apparent that many changes and modifications may be made in the general construction and arrangement of the present invention without departing from the spirit and scope thereof. Therefore, it is desired that the present invention be not limited to the exact disclosure but only to the extent of the appended claims.

I claim:

1. A modular roof structure, comprising:

a grid system of structural beams, said grid system comprising a plurality of parallel beams, each of which has a top side provided with an upward engaging protrusion;

each of said parallel beams having a plurality of roof tiles provided thereon, each of said roof tiles overlapping an adjacent said roof tile on an adjacent one of said parallel beams, each of said roof tiles having a front end and a rear end opposite to said front end, said front end being provided with a hook portion that extends from said front end and comprises a first elongated section with two opposed edges, one of said opposed edges abutting said parallel beam and being located adjacent to said engaging protrusion, a second section extending upwardly from one of said opposed edges of said first section, a third section extending from said second section, said third section being located above said first section and said front end, and a fourth section which interconnects said front end of said roof tile and said third section, wherein said second, third and fourth sections of said hook portion cooperatively define a receiving space to receive said engaging protrusion therein, said rear end of said roof tile having a projection that extends downward so as to abut said first elongated section of said adjacent roof tile, and further having a covering member extending from said rear end so as to shield said hook portion of said adjacent roof tile; and a fastener fastening said hook portion and said projection of said adjacent roof tile on said parallel beam.

2. A modular roof structure, comprising:

a grid system of structural beams, said grid system including a plurality of parallel beams, each of which is provided with an engaging protrusion that projects upward from a top side of said parallel beam;

each of said parallel beams having a plurality of roof tiles provided thereon, each of said roof tiles overlapping with an adjacent said roof tile on an adjacent one of said parallel beams, each of said roof tiles being made of aluminum alloy and having a front end and a rear end opposite to said front end, said front end being provided with a hook portion which receives said engaging protrusion therein, said hook portion comprising an oblique section which extends upwardly and inclinedly from said front end of said roof tile, a horizontal section that extends from said oblique section, and a vertical section which extends downwardly from said horizontal section and which cooperates with said oblique section and said horizontal section so as to form said receiving space of predetermined depth, said vertical section having a lower end abutting with said parallel beam, said projection of said adjacent roof tile abutting said vertical section, said rear end of said roof tile having a projection that extends downward so as to abut said hook portion of said adjacent roof tile on said adjacent one of said parallel beams, said rear end of said roof tile further having a covering member extending therefrom and shielding said hook portion of said adjacent roof tile; and fastener means for fastening said hook portion and said projection of said adjacent roof tile on said parallel beam.

3. The modular roof structure as defined in claim 2, wherein said projection has a threaded bore, said parallel beam having an elongated slot, said fastening means including an elongated plate member which extends from said lower end of said vertical section of said hook portion and which is disposed between said projection and said parallel beam, said elongated plate further having an opening formed therethrough, said fastening means further including a locking bolt extending through said elongated slot of said parallel beam and said opening of said elongated plate and being threaded in said threaded bore of said projection.

4. The modular roof structure as defined in claim 1, wherein said projection has a threaded bore, said first member having an opening which is aligned with said threaded bore, said parallel beam having an elongated slot, and wherein said fastener comprises a locking bolt extending through said elongated slot of said parallel beam and said opening of said elongated plate member, said locking bolt being threaded to engage said threads of said bore of said projection.

5. The modular roof structure as defined in claim 1 wherein said fastener comprises fastening means fastening said hook portion and said projection on said parallel beam.

6. The modular roof structure as defined in claim 1 wherein said roof tiles are made of aluminum alloy.

* * * * *